US008109099B2

(12) United States Patent
Tu et al.

(10) Patent No.: US 8,109,099 B2
(45) Date of Patent: Feb. 7, 2012

(54) FLOW SLEEVE WITH TABBED DIRECT COMBUSTION LINER COOLING AIR

(75) Inventors: John S. Tu, West Hartford, CT (US); Jaisukhlal V. Chokshi, Palm Beach Gardens, FL (US); Christopher R. Brdar, Rocky Hill, CT (US); Randal G. McKinney, Ellington, CT (US); Shakira A. Ramos, Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 659 days.

(21) Appl. No.: 12/169,994

(22) Filed: Jul. 9, 2008

(65) Prior Publication Data

US 2010/0005805 A1 Jan. 14, 2010

(51) Int. Cl.
*F02C 1/00* (2006.01)

(52) U.S. Cl. ..... 60/759; 60/752; 60/760

(58) Field of Classification Search ..... 60/752, 60/753, 754, 755, 758, 759, 760
See application file for complete search history.

(56) References Cited

U.S. PATENT DOCUMENTS

| | | | | |
|---|---|---|---|---|
| 4,184,326 | A * | 1/1980 | Pane et al. | 60/759 |
| 4,380,906 | A | 4/1983 | Dierberger | |
| 4,719,748 | A | 1/1988 | Davis | |
| 4,848,081 | A | 7/1989 | Kennedy | |
| 4,872,312 | A | 10/1989 | Iizuka | |
| 5,461,866 | A | 10/1995 | Sullivan | |
| 5,749,229 | A | 5/1998 | Abuaf | |
| 5,784,876 | A | 7/1998 | Alkabie | |
| 6,000,908 | A | 12/1999 | Bunker | |
| 6,484,505 | B1 | 11/2002 | Brown | |
| 7,311,175 | B2 | 12/2007 | Proscia | |
| 7,900,459 | B2 * | 3/2011 | Farah | 60/770 |

* cited by examiner

*Primary Examiner* — William H Rodriguez
*Assistant Examiner* — Arun Goyal
(74) *Attorney, Agent, or Firm* — Carlson, Gaskey & Olds, PC

(57) ABSTRACT

A combustion duct for a gas turbine engine has a combustion liner to receive products of combustion, and deliver the products of combustion downstream toward a turbine rotor. An outer housing is positioned radially outwardly of the combustion liner. A flow sleeve is positioned radially intermediate the outer housing and the combustion liner. A chamber radially outwardly of the flow sleeve receives cooling air. A plurality of holes through the flow sleeve deliver cooling air from the chamber against an outer periphery of the combustion liner. A plurality of tabs are associated with at least some of the holes in the flow sleeve. The tabs are positioned to extend radially inwardly on a downstream side of the holes.

5 Claims, 5 Drawing Sheets

FLOW SLEEVE WITH TABBED DIRECT COMBUSTION LINER COOLING AIR

BACKGROUND OF THE INVENTION

The present invention relates to a flow sleeve for controlling cooling airflow to an outer periphery of a combustion liner in a gas turbine engine.

Gas turbine engines are known, and typically include a compressor section that compresses air and delivers it downstream into a combustion section. The air is mixed with fuel in the combustion section and burned. Products of this combustion pass downstream towards a turbine section, to drive turbine rotors.

A combustion sleeve directs the products of combustion from the combustion section downstream toward the turbine rotors. The combustion liner becomes quite hot from the products of combustion. Thus, it is known to provide cooling air to an outer periphery of the combustion liner.

A part called a flow sleeve is mounted between an outer housing and the combustion liner, and provided with a plurality of openings. Cooling air is provided radially outwardly of the flow sleeve, and is directed through the holes at the outer periphery of the combustion liner. In this way, the combustion liner is cooled.

In one known flow sleeve, a plurality of tubular members extend about the holes, and from an inner periphery, to form conduits for controlling the direction in which the air is moved against the combustion liner. The tubular members add expense, and are complex to manufacture.

SUMMARY OF THE INVENTION

The present invention discloses a combustion liner to receive products of combustion in a gas turbine engine, and deliver the products of combustion downstream toward a turbine rotor. An outer housing is positioned radially outwardly of the combustion liner. A flow sleeve is positioned radially intermediate the outer housing and the combustion liner. The flow sleeve defines a chamber, radially outwardly of the flow sleeve, for receiving cooling air. A plurality of holes extend through the flow sleeve to deliver cooling air against an outer periphery of the combustion liner. A plurality of tabs are associated with at least some of the holes in the flow sleeve, and are positioned to extend radially inwardly on a downstream side of the holes.

The tabs control the air flow direction but are less expensive than the prior art.

These and other features of the present invention can be best understood from the following specification and drawings, the following of which is a brief description.

DETAILED DESCRIPTION OF THE PREFERRED EMBODIMENT

Figure 1:
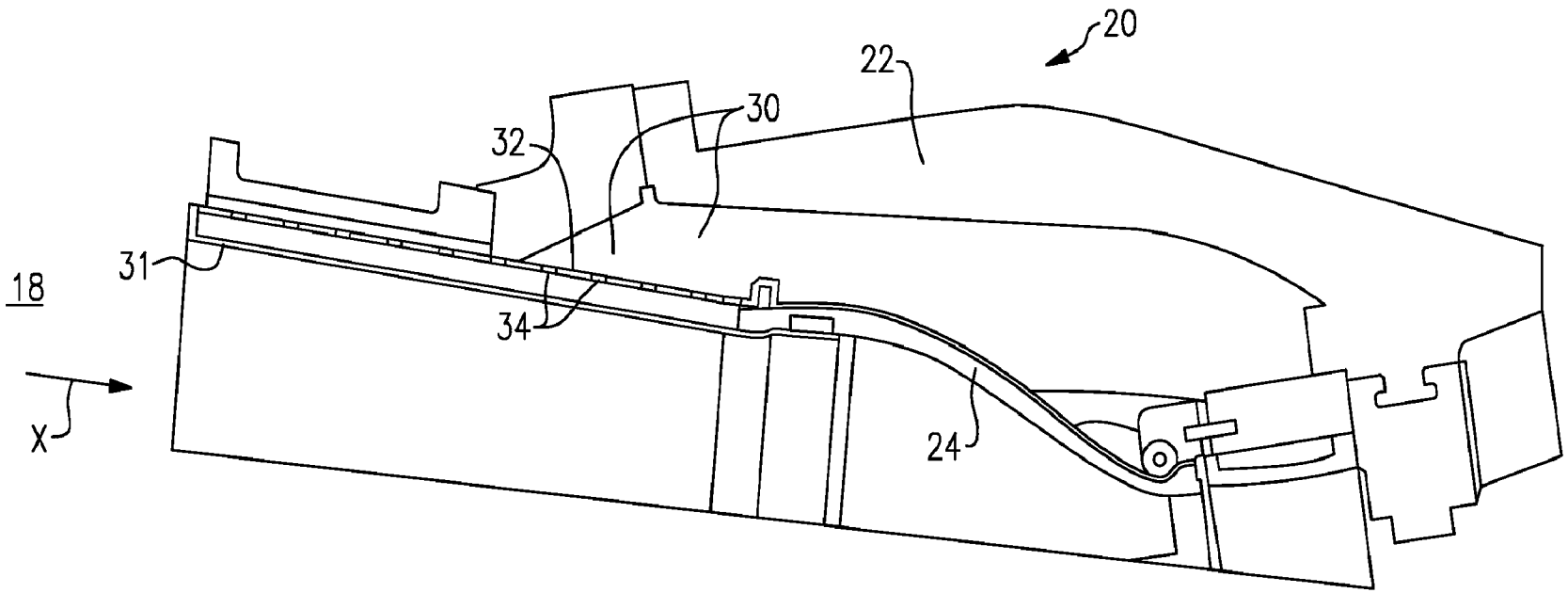
FIG. 1 shows a cross-sectional view of a combustion duct.

A combustion duct 20 for use in a gas turbine engine is illustrated in FIG. 1. An outer housing 22 connects to a downstream duct 24 leading to a turbine section (not shown). Outer housing 22 also surrounds a combustion liner 31. Combustion liner 31 receives products of combustion X from combustion section 18 and delivers them downstream into duct 24. A flow sleeve 32 is positioned radially between the outer housing 22 and the combustion liner 31. A chamber 30 between the flow sleeve 32 and the outer housing 22 receives cooling air, such as from an upstream compressor (not shown). Holes 34 are formed through the flow sleeve 32. Air passes from the chamber 30 through the holes 34, and against the outer periphery of the combustion liner 31.

Figure 2:
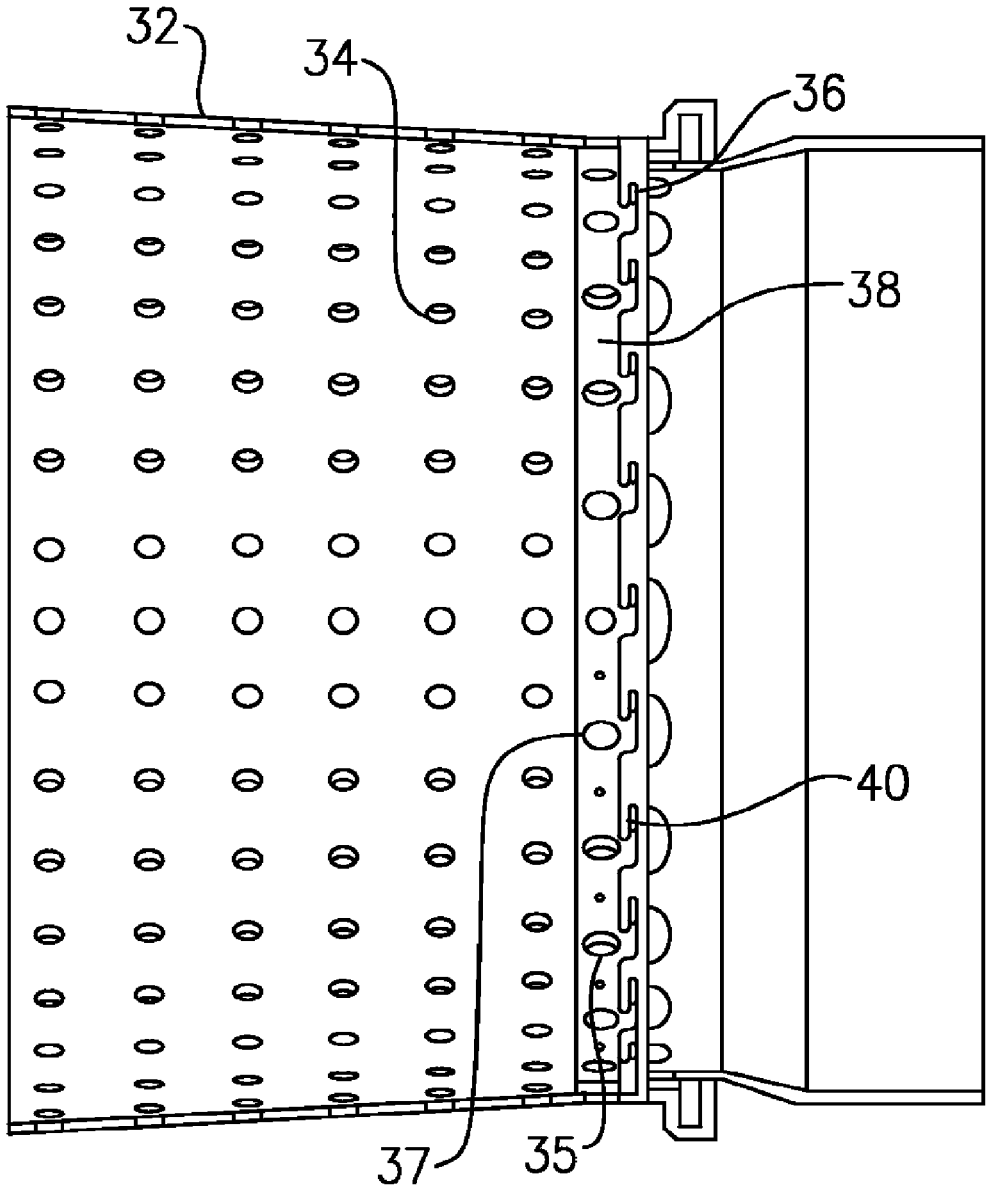
FIG. 2 shows a cross-sectional view of a flow sleeve with a tab ring.

As shown in FIG. 2, flow sleeve 32 and holes 34 may be supplemented at a downstream row of holes 35 by a tab ring 36. Tab ring 36 has a cylindrical base 38, and a plurality of tabs 40. Further, the base 38 includes holes 37 to be aligned with the last row of holes 35. As can be appreciated from FIG. 2, the tabs 40 do not extend over more than 180° defined about an axis extending through the holes 35. That is, tabs 40 are only on the downstream side of the holes 35. More specifically, as can be appreciated, the tabs 40 extend across less than 90°, and are generally formed to be tangent to an outer periphery of the hole at an upstream side. As can be appreciated from FIGS. 2 and 3, the tab 36 ring as disclosed extends over an entire 360° range about a central axis Z of the flow sleeve 32. In practice, the tab ring 36 may extend for less than 360°, but in embodiments, extends for at least 270° about the axis. Again, in the disclosed embodiment, the tab ring 36 does extend for 360° and is a complete ring. The tabs 40 and base 38 are formed as a single piece in a disclosed embodiment.

Figure 3:
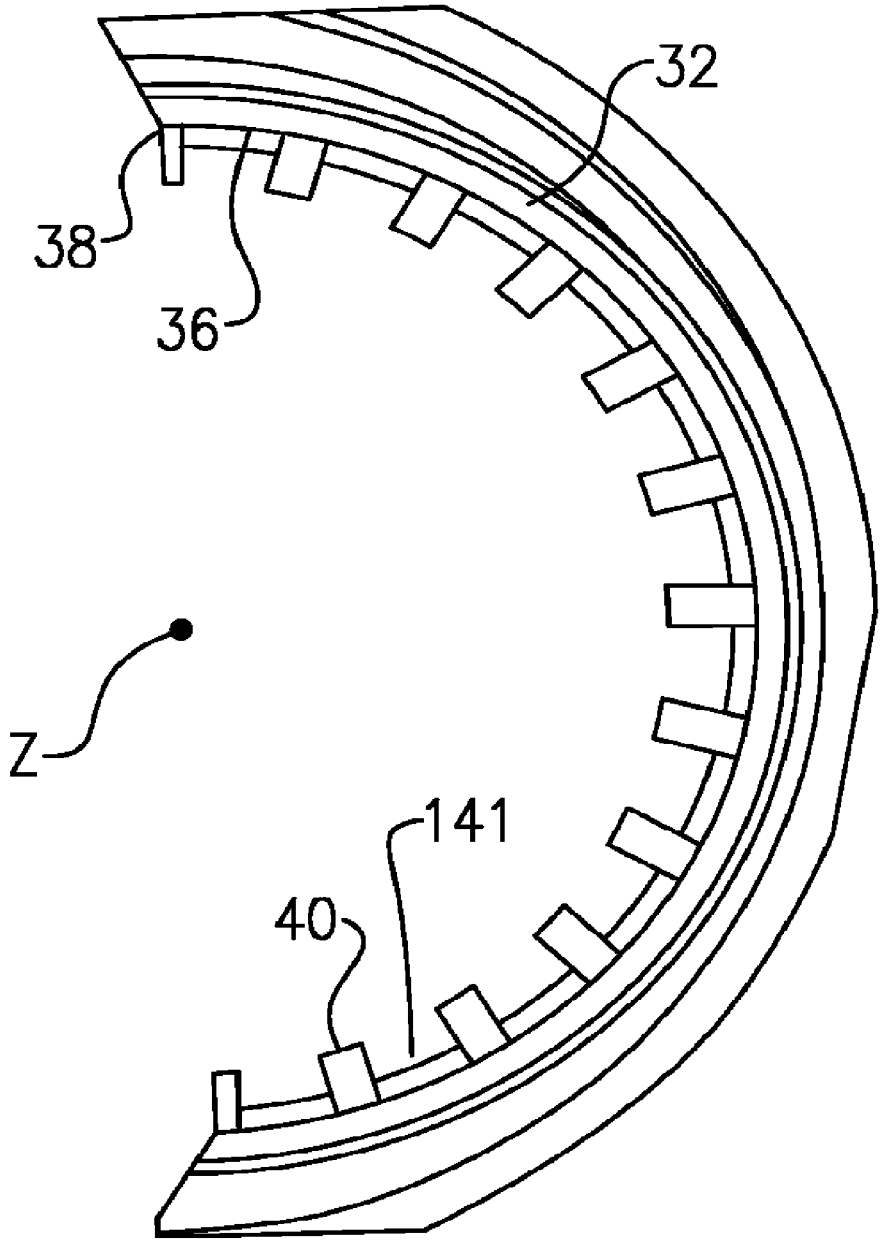
FIG. 3 is an end view of the FIG. 2 tab ring.

As can be appreciated from FIG. 3, tabs 40 extend radially inwardly from the base 38. As can be appreciated from FIG. 3, there are a plurality of circumferentially spaced tabs 40, intermediate spaces 141 circumferentially intermediate the plurality of tabs 40.

Figure 4:
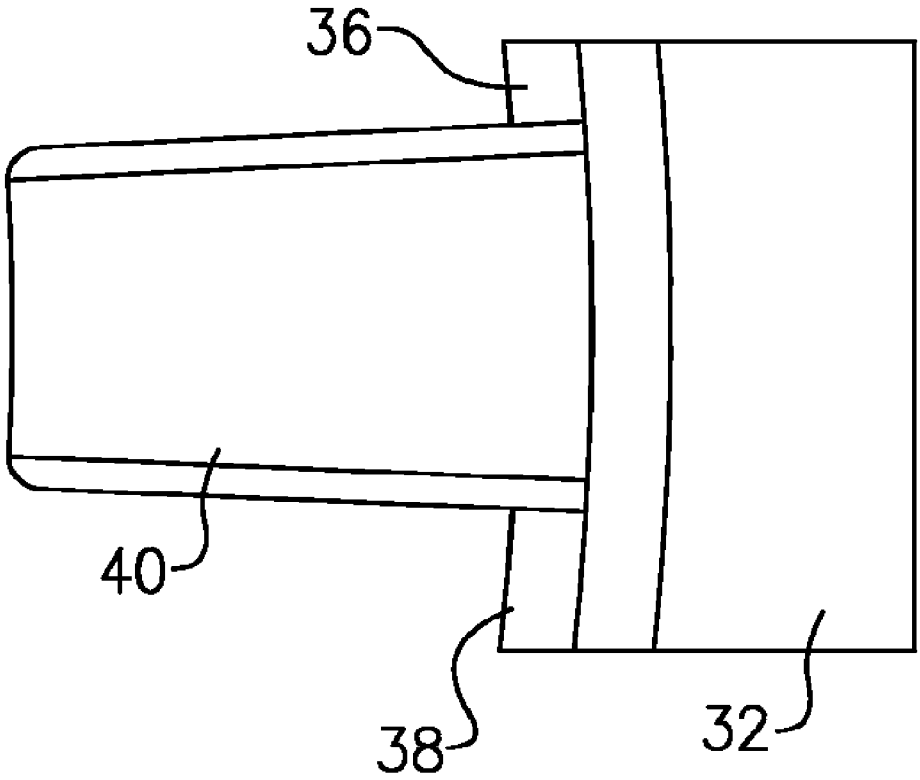
FIG. 4 shows a plan view tab of the FIG. 2 tab ring.

FIG. 4 shows the tab 40 extending inwardly from base 38, and positioned inwardly of the flow sleeve 32.

Figure 5:
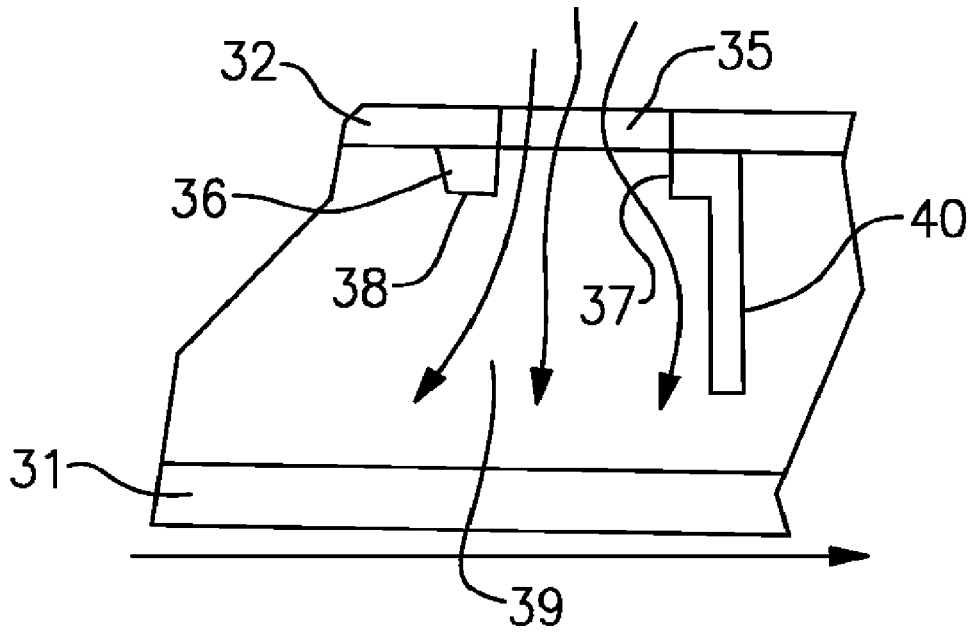
FIG. 5 shows a cross-sectional partial view of the flow sleeve and cooling tabs.

As can be appreciated from FIG. 5, the tabs 40 being aligned with the outer row of holes 35 shields cooling air from downstream cross-flow. Instead, cooling air from the holes 35 flows to an outer periphery of the combustion liner 31. Further, since the tabs 40 are only on a downstream side of the holes 35, and the base 38 does not extend as far radially inwardly as does the tab 40, the air is urged to flow back upstream, through the space 39 provided by the base 38. There will be a greater resistance to downstream flow due to the tab 40.

As can be appreciated, the tab ring 36 can be said to have an upstream side and a downstream side, and tabs 40 are at the downstream side. Notably, this description allows for a portion of the base to extend on a downstream side of the tabs 40. That is, the tabs 40 need not be at an extreme edge of the ring 36, and can still be said to be at the downstream side.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A combustion duct for a gas turbine engine comprising:

a combustion liner to receive products of combustion, and deliver them downstream toward a turbine rotor;

an outer housing positioned radially outwardly of said combustion liner;

a flow sleeve positioned radially intermediate said outer housing and said combustion liner, said flow sleeve defining a chamber, radially outwardly of said flow sleeve, for receiving cooling air, and a plurality of holes through said flow sleeve to deliver cooling air against an outer periphery of said combustion liner;

a plurality of tabs associated with at least some of said holes in said flow sleeve, said tabs being positioned to extend radially inwardly on a downstream side of said holes, and said tabs urging air that has passed through said holes back upstream;

said plurality of tabs being associated with a ring that extends for more than 270° about a central axis of said flow sleeve;

said ring having a cylindrical base within said flow sleeve, and said tabs extending radially inwardly for a greater distance than said base;

said base having base holes to correspond with said holes in said flow sleeve;

said flow sleeve and its plurality of holes being a separate part from said ring and said base holes;

said base holes in said ring surrounding said holes in said flow sleeve;

said plurality of tabs being circumferentially spaced; and there being spaces circumferentially intermediate said plurality of circumferentially spaced tabs.

2. The combustion duct as set forth in claim 1, wherein said plurality of tabs are associated with a downstream row of said holes.

3. The combustion duct as set forth in claim 1, wherein said ring extends for 360° .

4. A ring disposed along an inner periphery of a flow sleeve and for delivering cooling air to a combustion liner in a gas turbine engine, the ring comprising:

a cylindrical base extending for more than 270° about a central axis, and having base holes in said base;

the central axis defining an upstream side and a downstream side of said ring, a plurality of tabs positioned on said downstream side of said ring, said tabs extending radially inwardly and over less than 180° about an axis defined extending through said base holes, and said tabs urging air that has passed through said holes back upstream;

said tabs extending radially inwardly for a greater distance than said base;

said plurality of tabs being circumferentially spaced; and there being spaces circumferentially intermediate said plurality of circumferentially spaced tabs.

5. The ring as set forth in claim 4, wherein said ring extends for 360° about said central axis.

* * * * *